US010373273B2

(12) United States Patent
Brunn et al.

(10) Patent No.: US 10,373,273 B2
(45) **Date of Patent: *Aug. 6, 2019**

(54) EVALUATING AN IMPACT OF A USER'S CONTENT UTILIZED IN A SOCIAL NETWORK

(71) Applicant: International Business Machines Corporation, Armonk, NY (US)

(72) Inventors: Jonathan F. Brunn, Logan, UT (US); Jeffrey R. Hoy, Southern Pines, NC (US); Asima Silva, Holden, MA (US)

(73) Assignee: International Business Machines Corporation, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/720,093

(22) Filed: Sep. 29, 2017

(65) Prior Publication Data

US 2018/0025441 A1 Jan. 25, 2018

Related U.S. Application Data

(63) Continuation of application No. 14/684,341, filed on Apr. 11, 2015, now Pat. No. 9,881,345.

(51) Int. Cl.
*G06Q 50/00* (2012.01)

(52) U.S. Cl.
CPC ..... *G06Q 50/01* (2013.01)

(58) Field of Classification Search
CPC ..... G06Q 50/01; G06F 17/30867; G06F 17/30864; G06F 17/3053; G06F 17/30035
(Continued)

(56) References Cited

U.S. PATENT DOCUMENTS 8,312,056 B1 11/2012 Peng et al.
8,396,897 B2 3/2013 Rohall
(Continued)

FOREIGN PATENT DOCUMENTS

JP 2012252586 A 12/2012
WO 2007001639 A2 1/2007
(Continued)

OTHER PUBLICATIONS

Bergman et al., "Outline Wizard: Presentation Composition and Search," IBM Research Report, Jul. 27, 2010, pp. 1-11.
(Continued)

*Primary Examiner* — Hosain T Alam
*Assistant Examiner* — Nicholas E Allen
(74) *Attorney, Agent, or Firm* — Robert A. Voigt, Jr.; Winstead, P.C.

(57) ABSTRACT

A method, system and computer program product for evaluating an impact of a user's content utilized in a social network. Content in a document (e.g., a presentation) that has been posted on a social network environment is detected as being reused by another user in another document. The author of the reused content is then identified. A counter keeping track of the number of times this content has been adopted in derivative works is then incremented. A score ("impact score"), representing the author's ability to influence other users to adopt the author's content in other users' derivative works, is then generated based on the number of times this content has been adopted in derivative works. Social credit is then provided to the author using the impact score. In this manner, recognition is provided to the author thereby providing motivation for users to post created content in the social network.

20 Claims, 7 Drawing Sheets

(58) Field of Classification Search
USPC ..... 707/734
See application file for complete search history.

(56) References Cited

U.S. PATENT DOCUMENTS

| | | | | |
|---|---|---|---|---|
| 8,407,806 | B2 | 3/2013 | Agrawal et al. | |
| 8,756,224 | B2 | 6/2014 | Dassa et al. | |
| 2009/0006388 | A1 | 1/2009 | Ives et al. | |
| 2012/0102021 | A1* | 4/2012 | Hill | G06F 17/30964 707/711 |
| 2012/0215903 | A1* | 8/2012 | Fleischman | G06Q 30/0201 709/224 |
| 2012/0226748 | A1* | 9/2012 | Bosworth | G06Q 10/103 709/204 |
| 2013/0179511 | A1 | 7/2013 | Stevens et al. | |
| 2013/0311484 | A1 | 11/2013 | Zhou et al. | |
| 2014/0019539 | A1* | 1/2014 | Novak | G06Q 30/0201 709/204 |
| 2014/0156681 | A1* | 6/2014 | Lee | G06F 17/30699 707/754 |
| 2014/0222928 | A1* | 8/2014 | Scholtes | H04L 51/046 709/206 |
| 2014/0236923 | A1 | 8/2014 | Catledge | |
| 2014/0330594 | A1* | 11/2014 | Roberts | G06Q 10/06316 705/4 |
| 2014/0337257 | A1* | 11/2014 | Chatterjee | G06N 99/005 706/12 |
| 2014/0337359 | A1* | 11/2014 | Airoldi | G06F 17/3053 707/748 |
| 2015/0066832 | A1* | 3/2015 | Kulik | H04L 63/14 706/47 |
| 2015/0095355 | A1* | 4/2015 | Patton | G06F 17/30241 707/754 |
| 2015/0100377 | A1* | 4/2015 | Penumaka | G06Q 30/0201 705/7.29 |
| 2018/0025441 | A1* | 1/2018 | Brunn | G06Q 50/01 707/734 |

FOREIGN PATENT DOCUMENTS

| | | | |
|---|---|---|---|
| WO | 2007117643 | A2 | 10/2007 |
| WO | 2013160904 | A1 | 10/2013 |

OTHER PUBLICATIONS

Chi et al., "Dandelion: Supporting Coordinated, Collaborative Authoring in Wikis," CHI 2010, Apr. 10-15, 2010, Atlanta, Georgia, U.S.A., pp. 1199-1202.
Agichtein et al., "Finding High-Quality Content in Social Media," WSDM'08, Feb. 11-12, 2008, Palo Alto, California, U.S.A., pp. 183-193.
Romero et al., "Influence and Passivity in Social Media," ECML PKDD 2011, Part III, LNAI 6913, 2011, pp. 18-33.
List of IBM Patents or Patent Applications Treated as Related, Sep. 29, 2017, pp. 1-2.

* cited by examiner

EVALUATING AN IMPACT OF A USER'S CONTENT UTILIZED IN A SOCIAL NETWORK

TECHNICAL FIELD

The present invention relates generally to social network services, and more particularly to evaluating an impact of a user's content utilized in a social network and altering the content of an activity stream to prioritize content with a higher impact or from a user with a greater influence.

BACKGROUND

A social network service is an online service, platform or site that focuses on building social networks or social relations among people (e.g., those who share interests and/or activities). A social network service essentially consists of a representation of each user (often a profile), his/her social links, and a variety of additional services. Most social network services are web-based and provide means for users to interact over the Internet, such as by e-mail and instant messaging. Social networking sites allow users to share ideas, activities, events, and interests within their individual networks.

Currently, there has been a trend in attempting to assess the interactions between people, topics and ideas that occur in a social network environment. As a result, various "social metrics" have been utilized, such as volume (number of posts), reach (size of audience), and engagement/conversation/applause rates (number of likes, shares, etc.). These metrics provide valuable insights especially when a large amount of data is available to aggregate results.

However, these metrics are deficient in attempting to assess the impact of ideas from individual posters, such as within an organization or community. That is, these metrics are deficient in attempting to assess the impact of content created by a user that is utilized in a social network. For example, an individual user, especially within a private organization, may have a large number of followers or a high engagement just because of the user's current role in the organization. Hence, the current social metrics of engagement or number of followers would not necessarily indicate the impact of the poster's created content that is utilized in a social network. In another example, a user may receive a lot of likes and comments by posting about the accomplishments or accolades of the user's colleagues without contributing new ideas. Hence, the current social metrics of likes and comments would not necessarily indicate an impact of content created from such a user.

However, a user with few followers may contribute ideas which have broad impact in an organization. In a social network, especially an enterprise social network, it is common for content of a document (e.g., e-mail message, a post, a word processing document, a presentation) to be reappropriated and reused, often without the original author's knowledge or consent and in a different form than the original content. This may happen when sections of a document are reused in another document. For example, the content in an author's document may be reused in another user's status update or blog or in a wiki authored by another user. In another example, the text from a technical wiki page may become part of a presentation used by a marketing team.

Unfortunately, the authorship is attributed to the person who submits the content to the social network, and the actual original author of the content may not receive any credit for the creation of such content. Content may not only be directly shared in the social network as-is, but may be taken out of the social network, altered, added to, or quoted without attribution, making it difficult to credit the original author.

Organizations have attempted to motivate their employees to contribute new and valuable ideas and insights through their social networks. However, there are not currently sufficient metrics for evaluating the impact of content created by a user that is utilized in a social network thereby not providing any means for recognizing the impact of the user's content. As a result, there is less motivation for users to post created content in a social network because of a lack of recognition Furthermore, users miss important content buried in a long list of updates from their network and groups, communities or pages they follow. Communicators and content consumers in a social network miss important content being created in their networks. Valuable insights are lost.

Additionally, individuals in social networks may serve as catalysts for information sharing, being themselves unimportant for content and knowledge creation, but critical to information aggregation, curation and distribution. While individuals will rarely leave a personal social network, enterprise networks are characterized by constant change with employees and business partners constantly changing. When nodes of the network are removed from the network, knowledge sharing and information distribution are disrupted. Content creators may no longer be as connected with individuals who have historically consumed their work in the form of a derivative content.

SUMMARY

In one embodiment of the present invention, a method for evaluating an impact of a user's content utilized in a social network comprises detecting content in a document posted on a social network environment being reused by a second user. The method further comprises identifying an author of the content. The method additionally comprises incrementing a first counter keeping track of a number of times the content has been adopted in derivative works, wherein the derivative works are works based on or derived from the content. Furthermore, the method comprises generating, by a processor, an impact score representing an ability of the author to influence other users to adopt the content in derivative works of the other users based on the number of times the content has been adopted in the derivative works. Additionally, the method comprises providing social credit to the author of the content using the impact score.

Other forms of the embodiment of the method described above are in a system and in a computer program product.

The foregoing has outlined rather generally the features and technical advantages of one or more embodiments of the present invention in order that the detailed description of the present invention that follows may be better understood. Additional features and advantages of the present invention will be described hereinafter which may form the subject of the claims of the present invention.

BRIEF DESCRIPTION OF THE DRAWINGS

A better understanding of the present invention can be obtained when the following detailed description is considered in conjunction with the following drawings, in which.

DETAILED DESCRIPTION

The present invention comprises a method, system and computer program product for evaluating an impact of a user's content utilized in a social network. In one embodiment of the present invention, content in a document (e.g., a social media post, an electronic message, a word processing document, a presentation) that has been posted on a social network environment is detected as being reused by another user in another document. The author of the reused content is then identified. A counter keeping track of the number of times this content has been adopted in derivative works is then incremented. A score, referred to herein as the "impact score," representing the author's ability to influence other users to adopt the author's content in other users' derivative works, is then generated based on the number of times this content has been adopted in derivative works. In this manner, the impact of the author's content being utilized in a social network can be evaluated. Social credit is then provided to the author using the impact score. In this manner, recognition is provided to the author of the content being utilized in a social network thereby providing motivation for users to post created content in the social network.

In the following description, numerous specific details are set forth to provide a thorough understanding of the present invention. However, it will be apparent to those skilled in the art that the present invention may be practiced without such specific details. In other instances, well-known circuits have been shown in block diagram form in order not to obscure the present invention in unnecessary detail. For the most part, details considering timing considerations and the like have been omitted inasmuch as such details are not necessary to obtain a complete understanding of the present invention and are within the skills of persons of ordinary skill in the relevant art.

Figure 1:
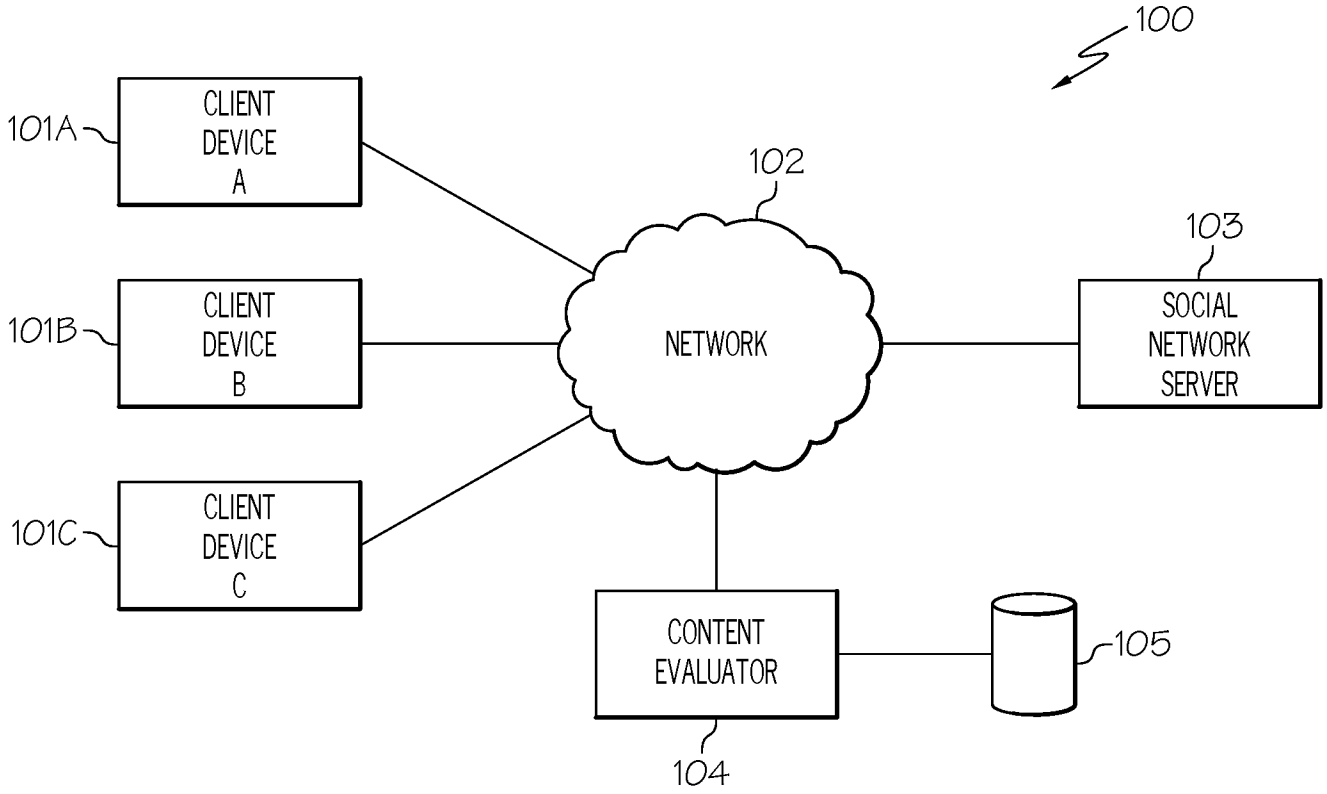
FIG. 1 illustrates a social network system configured in accordance with an embodiment of the present invention.

Referring now to the Figures in detail, FIG. 1 illustrates a social network system 100 configured in accordance with an embodiment of the present invention. Referring to FIG. 1, social network system 100 includes a community of users using client devices 101A-101C (identified as "Client Device A," "Client Device B," and "Client Device C," respectively, in FIG. 1) to be involved in social network system 100. Client devices 101A-101C may collectively or individually be referred to as client devices 101 or client device 101, respectively. Client device 101 may be a portable computing unit, a Personal Digital Assistant (PDA), a smartphone, a laptop computer, a mobile phone, a navigation device, a game console, a desktop computer system, a workstation, an Internet appliance and the like.

Client devices 101 may participate in a social network by communicating (by wire or wirelessly) over a network 102, which may be, for example, a local area network, a wide area network, a wireless wide area network, a circuit-switched telephone network, a Global System for Mobile Communications (GSM) network, Wireless Application Protocol (WAP) network, a WiFi network, an IEEE 802.11 standards network, various combinations thereof, etc. Other networks, whose descriptions are omitted here for brevity, may also be used in conjunction with system 100 of FIG. 1 without departing from the scope of the present invention.

System 100 further includes a social network server 103, which may be a web server configured to offer a social networking and/or microblogging service, enabling users of client devices 101 to send and read other users' posts. "Posts," as used herein, include any one or more of the following: text (e.g., messages, comments, sub-comments and replies), audio, video images, etc. Social network server 103 is connected to network 102 by wire or wirelessly. While FIG. 1 illustrates a single social network server 103, it is noted for clarity that multiple servers may be used to implement the social networking and/or microblogging service.

System 100 further includes a content evaluator 104 connected to network 102 by wire or wirelessly. Content Evaluator 104 is configured to evaluate an impact of a user's content (e.g., content created by a user of client device 101) utilized in a social network as discussed in further detail below. "Content," as used herein, refers to the ideas expressed in a portion or entirety of a document. A "document," as used herein, refers to any written communication that is posted on a social network environment, such as a social media post, an electronic message, a word processing document, a presentation, etc. A description of the hardware configuration of content evaluator 104 is provided below in connection with FIG. 2.

System 100 additionally includes a database 105 connected to content evaluator 104 that stores hash values from analyzing document contents as well as a mapping of authors to the stored hash values. In one embodiment, content may be stemmed or otherwise normalized followed by using a hashing algorithm to analyze the contents of a document to generate hash values representing the contents. Normalizing a document may include removal of slide master elements, converting the document to text, removing punctuation, correcting spelling, replacing words with their most common synonyms, removing conjunctive expressions and other expressions which may be unique to an author's tone and may change in derivative works and removing articles which do not alter the meaning of the text. These hash values may be compared with other previously stored hash values to determine if there is a match in the contents. For those contents that are deemed to be original works of authorship, such as based on the creation time, upload time or metadata of the document indicating the creation time, the user that posted the document on the social network at such a time will be deemed to be the author of the content and will be associated with the hash values generated for the content. In one embodiment, each document may have multiple hash values, where each hash value may be associated with some content in the document and each content may have a unique author.

In one embodiment, database 105 stores a mapping of the documents with reused content with the document containing the source of the reused content, annotated with references to specific content which is reused. In one embodiment, the creation time, upload time or metadata of the document containing the reused content may be used to identify the document containing the source of the reused content, which may or may not be the author's document. Such information is stored in database 105 to generate a graphical representation of the relationship between documents representing an influence of the author's content being incorporated in other derivative works as discussed further below.

System 100 is not to be limited in scope to any one particular network architecture. System 100 may include any number of clients 101, networks 102, social network servers 103, content evaluators 104 and databases 105. Furthermore, in one embodiment, content evaluator 104 may be part of client device 101 or social network server 103.

Figure 2:
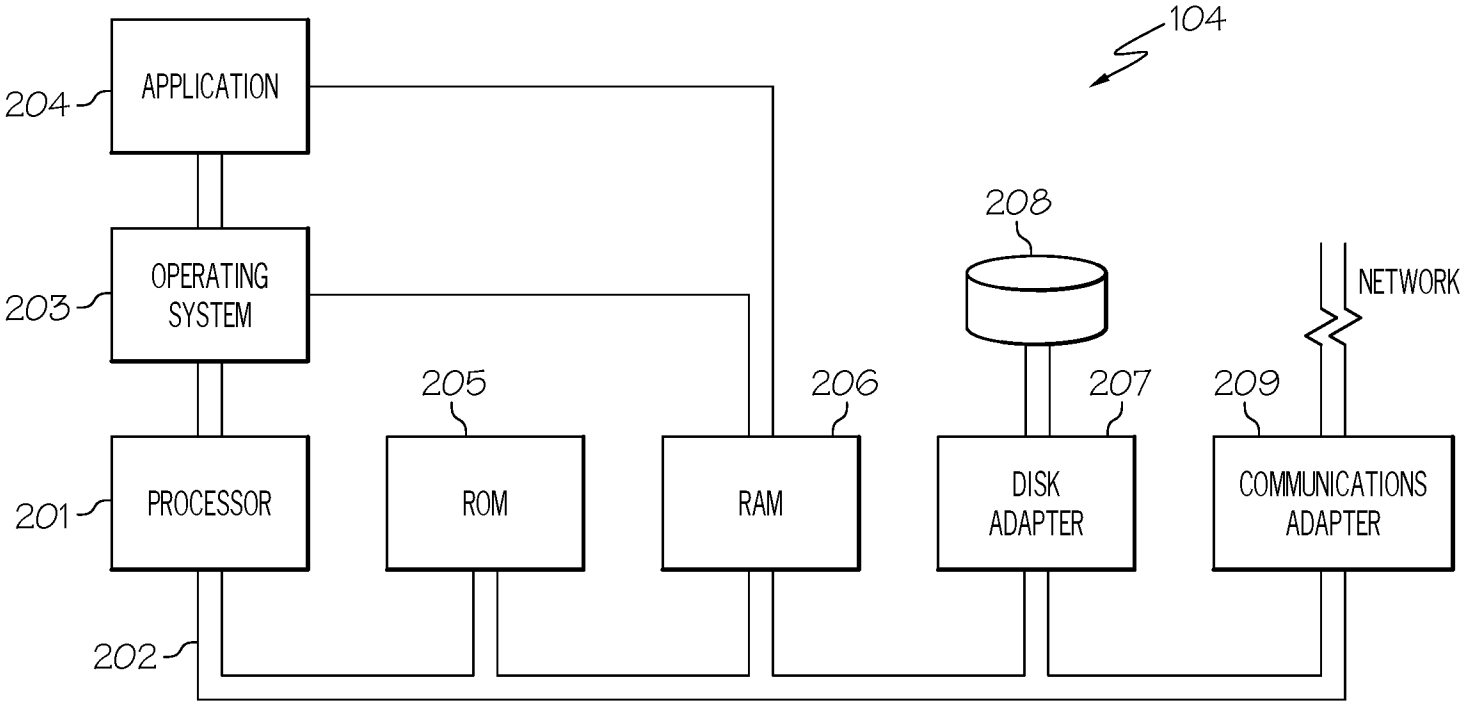
FIG. 2 illustrates a hardware configuration of a content evaluator configured in accordance with an embodiment of the present invention.

Referring now to FIG. 2, FIG. 2 illustrates a hardware configuration of content evaluator 104 (FIG. 1) which is representative of a hardware environment for practicing the present invention. Referring to FIG. 2, content evaluator 104 has a processor 201 coupled to various other components by system bus 202. An operating system 203 runs on processor 201 and provides control and coordinates the functions of the various components of FIG. 2. An application 204 in accordance with the principles of the present invention runs in conjunction with operating system 203 and provides calls to operating system 203 where the calls implement the various functions or services to be performed by application 204. Application 204 may include, for example, a program for evaluating an impact of a user's content utilized in a social network as discussed further below in association with FIGS. 3A-3B and 4-6.

Referring again to FIG. 2, read-only memory ("ROM") 205 is coupled to system bus 202 and includes a basic input/output system ("BIOS") that controls certain basic functions of content evaluator 104. Random access memory ("RAM") 206 and disk adapter 207 are also coupled to system bus 202. It should be noted that software components including operating system 203 and application 204 may be loaded into RAM 206, which may be content evaluator's 104 main memory for execution. Disk adapter 207 may be an integrated drive electronics ("IDE") adapter that communicates with a disk unit 208, e.g., disk drive. It is noted that the program for evaluating an impact of a user's content utilized in a social network, as discussed further below in association with FIGS. 3A-3B and 4-6, may reside in disk unit 208 or in application 204.

Content evaluator 104 may further include a communications adapter 209 coupled to bus 202. Communications adapter 209 interconnects bus 202 with an outside network (e.g., network 102 of FIG. 1) thereby allowing content evaluator 104 to communicate with client devices 101 and social network server 103.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Figure 3A:
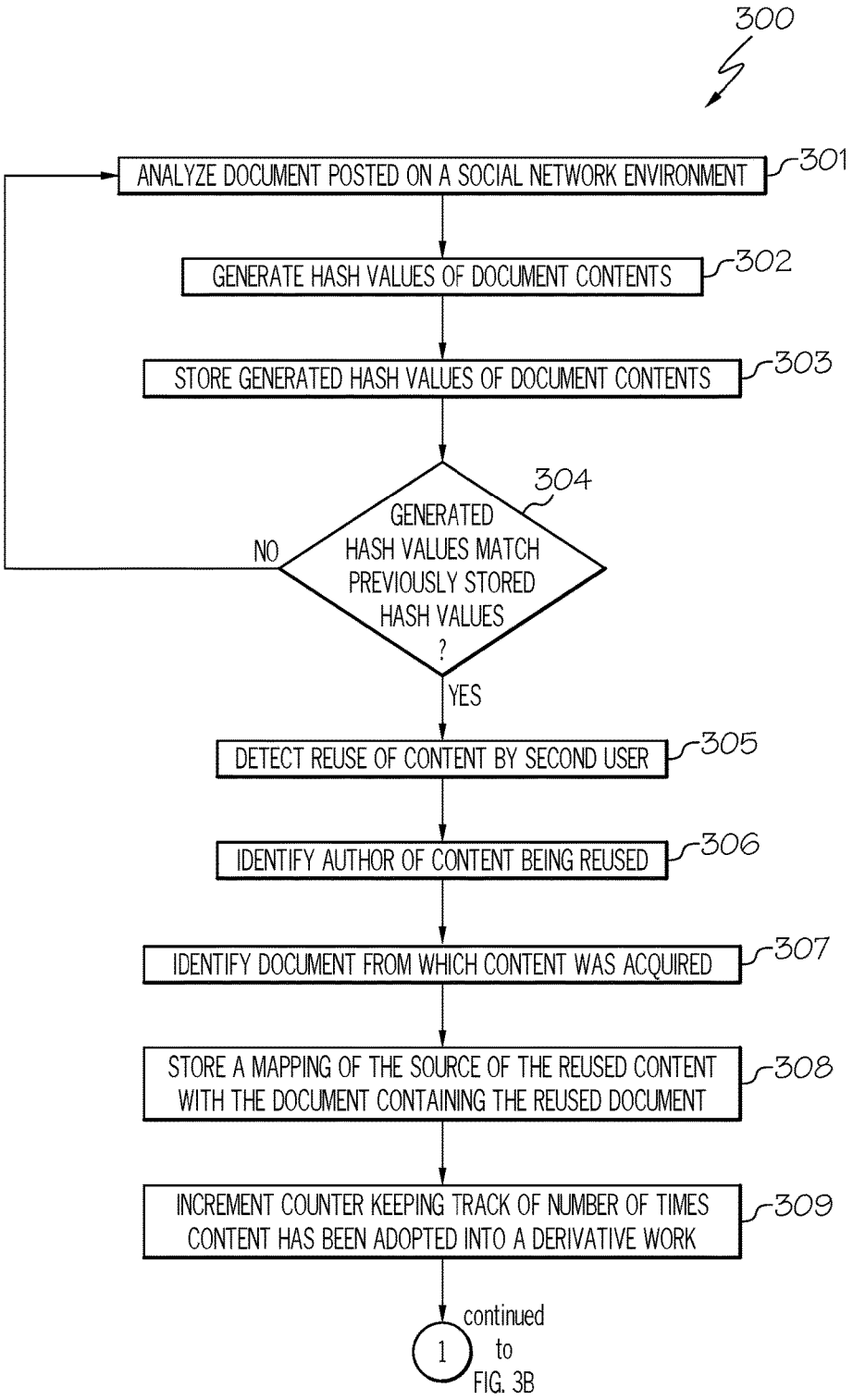
FIGS. 3A-3B are a flowchart of a method for evaluating an impact of the user's content utilized in a social network in accordance with an embodiment of the present invention.
Figure 3B:
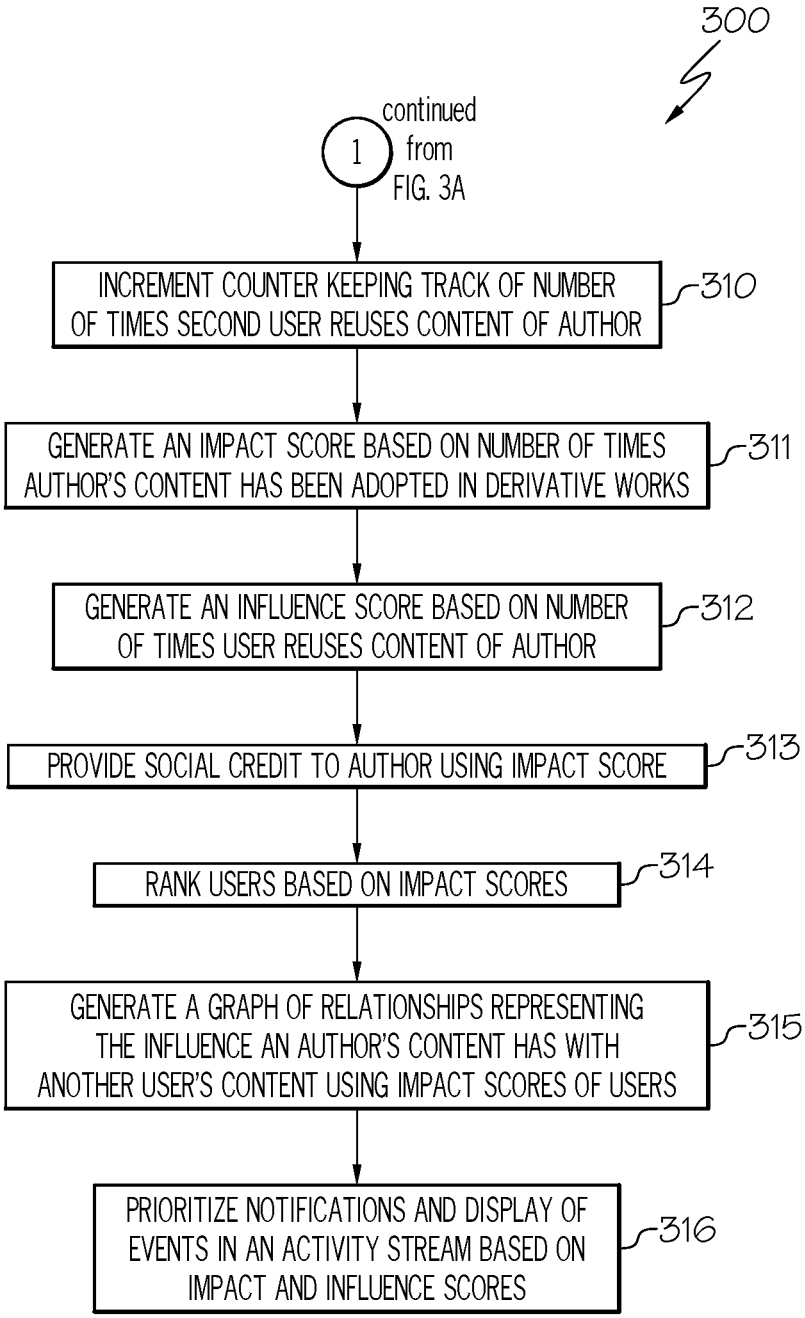
Figure 4:
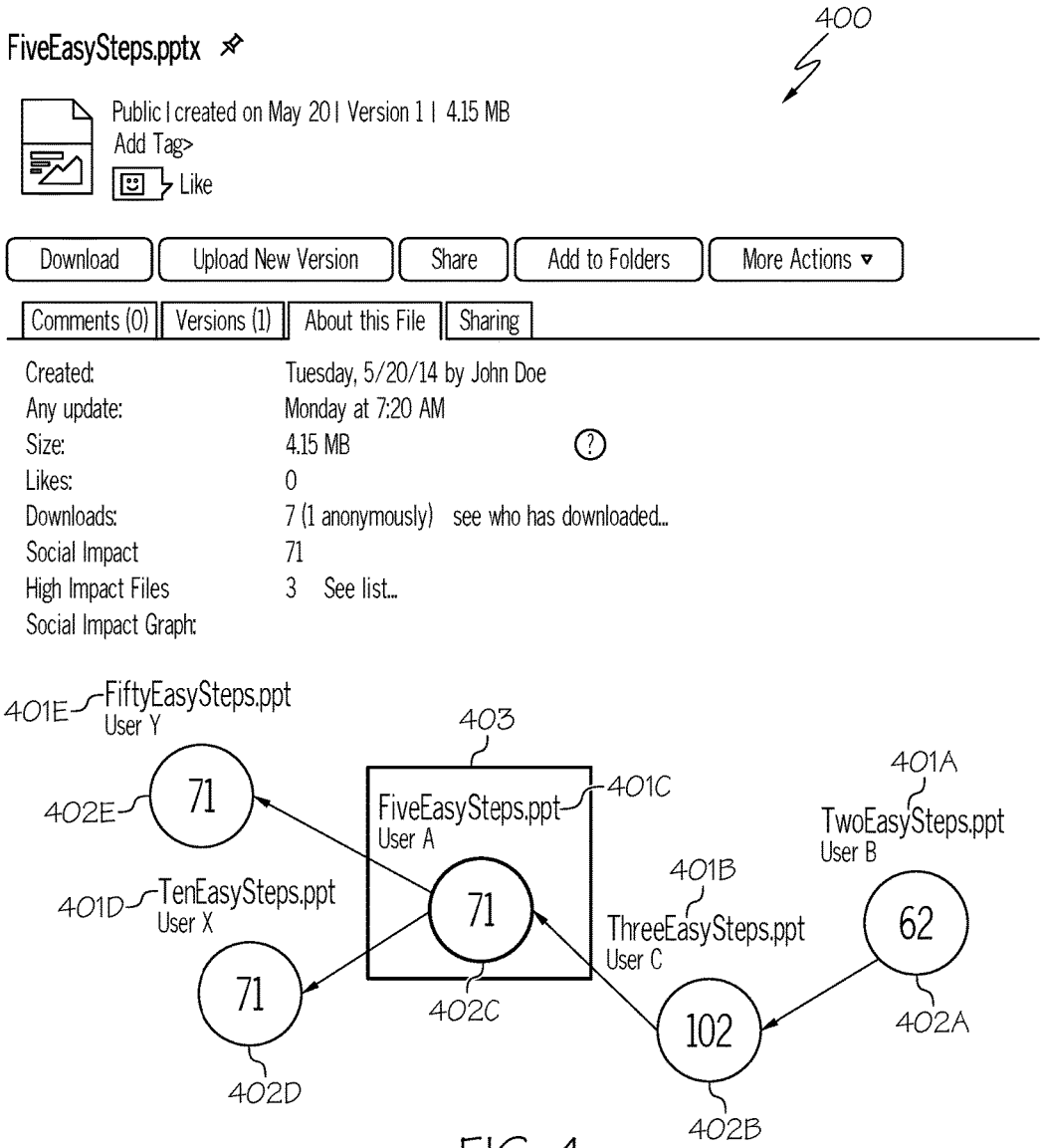
FIG. 4 is a graph representing the author's ability to influence other users to adopt the author's content in the other users' derivative works in accordance with an embodiment of the present invention.
Figure 5:
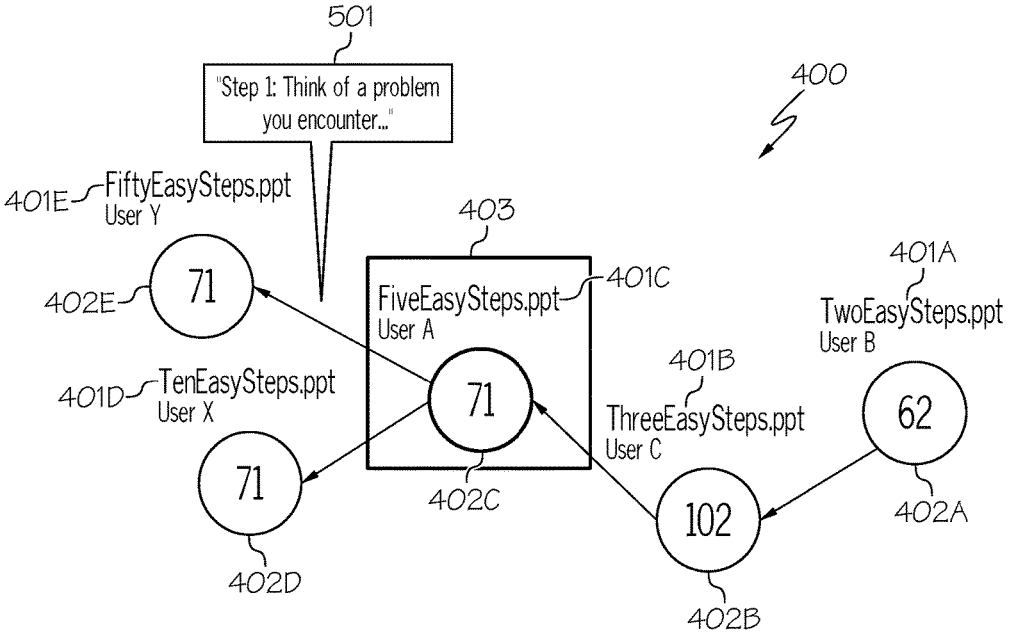
FIG. 5 illustrates a user identifying which content was reused in a particular document in accordance with an embodiment of the present invention.
Figure 6:
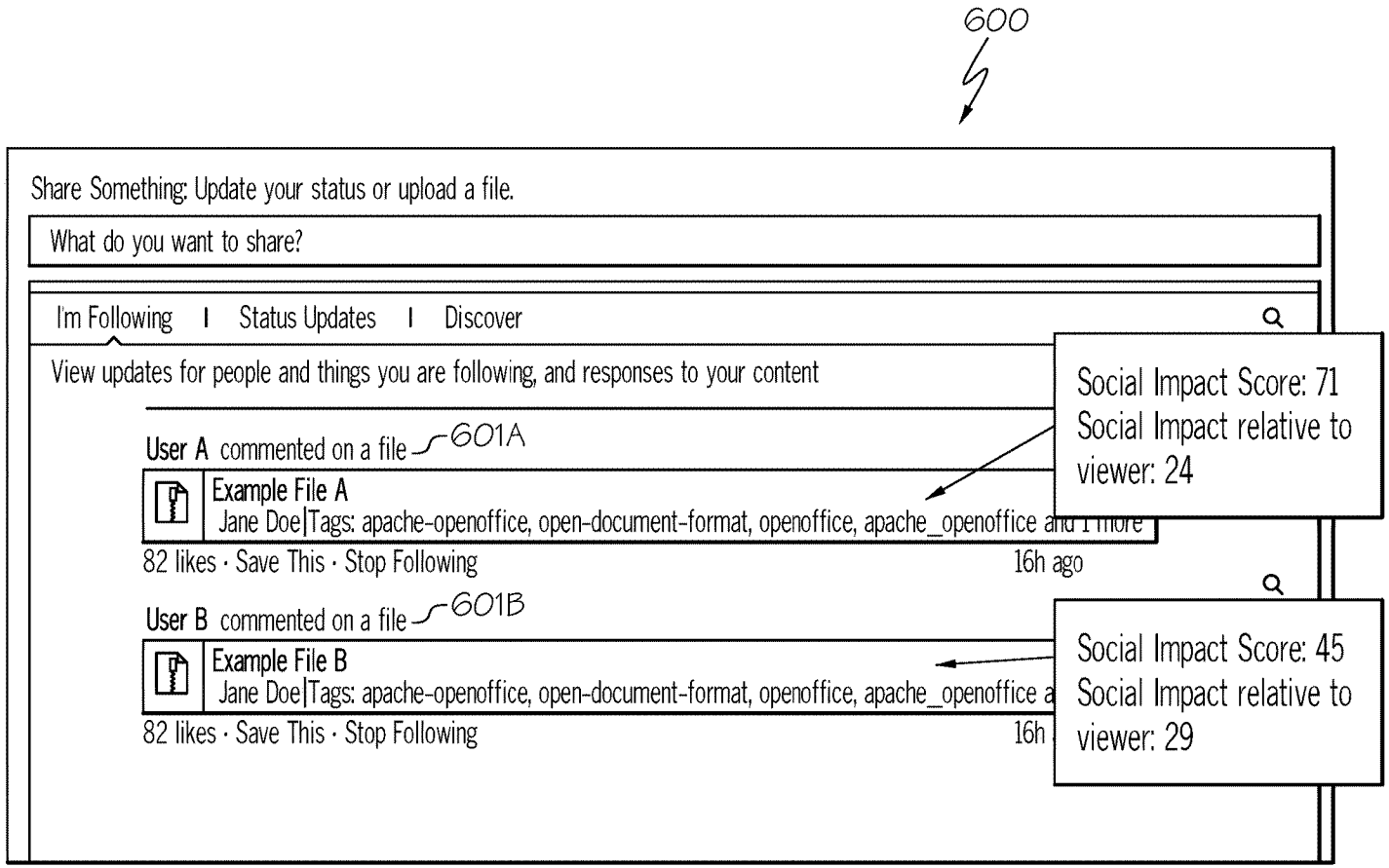
FIG. 6 illustrates an activity stream prioritizing notifications and the display of events based on the impact and influence scores in accordance with an embodiment of the present invention.

As stated in the Background section, in a social network, especially an enterprise social network, it is common for content of a document (e.g., e-mail message, a post, a word processing document, a presentation) to be reappropriated and reused, often without the original author's knowledge or consent and in a different form than the original content. This may happen when sections of a document are reused in another document. For example, the content in an author's document may be reused in another user's status update or blog or in a wiki authored by another user. In another example, the text from a technical wiki page may become part of a presentation used by a marketing team. Unfortunately, the authorship is attributed to the person who submits the content to the social network, and the actual original author of the content may not receive any credit for the creation of such content. Content may not only be directly shared in the social network as-is, but may be taken out of the social network, altered, added to, or quoted without attribution, making it difficult to credit the original author. Organizations have attempted to motivate their employees to contribute new and valuable ideas and insights through their social networks. However, there are not currently sufficient metrics for evaluating the impact of content created by a user that is utilized in a social network thereby not providing any means for recognizing the impact of the user's content. As a result, there is less motivation for users to post created content in a social network because of a lack of recognition The principles of the present invention provide a means for providing recognition to an author of content utilized in a social network by evaluating the impact of the author's content utilized in the social network thereby providing motivation for users to post created content in the social network as discussed below in association with FIGS. 3A-3B and 4-6. FIGS. 3A-3B are a flowchart of a method for evaluating an impact of the user's content utilized in a social network. FIG. 4 is a graph representing the author's ability to influence other users to adopt the author's content in the other users' derivative works. FIG. 5 illustrates a user identifying which content was reused in a particular document. FIG. 6 illustrates an activity stream prioritizing notifications and the display of events based on the impact and influence scores.

As stated above, FIGS. 3A-3B are a flowchart of a method 300 for evaluating an impact of the user's content utilized in a social network in accordance with an embodiment of the present invention.

Referring to FIG. 3A, in conjunction with FIGS. 1-2, in step 301, content evaluator 104 analyzes a document posted on a social network environment. As discussed above, a "document," as used herein, refers to any written communication that is posted on a social network environment, such as a social media post, an electronic message, a word processing document, a presentation, etc.

In step 302, content evaluator 104 generates hash values of the document contents. In one embodiment, a hashing algorithm, such as Charikar's hash, is used to generate a hash value of a portion (e.g., a page) or an entirety of the document. A locality sensitive hashing scheme may be employed to maximize collisions of hashes for similar content. Hash values are computed for the entire document and along common boundaries, such as sentence, paragraph and page boundaries.

In step 303, content evaluator 104 stores the generated hash values of the document contents.

In step 304, a determination is made by content evaluator 104 as to whether the generated hash values (generated in step 302) match any previously stored hash values, such as those stored in database 105. The previously stored hash values refer to the hash values that were generated from previously analyzed documents.

If the generated hash values (generated in step 302) do not match any previously stored hash values, then content evaluator 104 analyzes another document posted on the social network environment in step 301.

If, however, the generated hash values (generated in step 302) match a previously stored hash value, then, in step 305, content evaluator 104 detects the reuse of content by a user (e.g., user of client device 101B). While the foregoing discusses the use of a hashing algorithm to determine the reuse of contents by a user, the present invention is not to be limited in such a manner. The present invention includes any means for detecting the reuse of content by a user, such as utilizing metadata embedded within the document which includes information regarding which portions of the document have been reused, including the source of the reused content (e.g., name of document) as well as the author of the content that was reused.

In step 306, content evaluator 104 identifies the author of the content (e.g., user of client device 101A) that was being reused. In one embodiment, the author of the content that was being reused may be identified from the mapping of the author to the hash values stored in database 105 that was used to identify matching contents. That is, the author is identified based on the hash value associated with the author's content matching the hash value generated in step 302. In another embodiment, the author of the content that was being reused is identified from the metadata embedded within the document, where the metadata identifies the source of the reused content (e.g., name of the document from which the content was acquired) as well as the author of the reused content.

In step 307, content evaluator 104 identifies the document from which the content (the reused content) was acquired. In one embodiment, the creation time, upload time or metadata of the document containing the reused content may be used to identify the document containing the source of the reused content, which may or may not be the author's document.

In step 308, content evaluator 104 stores a mapping of the source of the reused content with the document containing the reused document, such as in database 105. As will be discussed further below, content evaluator 104 generates a graphical representation of the relationship between documents representing an influence of the author's content being incorporated in other derivative works as discussed further below.

In step 309, content evaluator 104 increments counters keeping track of the number of times the content has been adopted in derivative works. In one embodiment, a record is also created in a database (e.g., database 105) to reference the specific time of reuse. The greater the number of times the content has been adopted in derivative works, the greater the influence that the author has in influencing other users to adopt the author's content into derivative works. In one embodiment, the counter is implemented in software (e.g., application 204). In another embodiment, the counter is implemented in hardware or a combination of hardware and software.

In one embodiment, the content evaluation increments a number of counters on documents and users, including one which records global impact of the document (a document impact score), one which records the global impact of the author on documents not authored by the user (a user impact score), one which records the impact of a document with respect to the documents of another user for each document/user pair where the user derives work from the document (a document influence score), and one which records the impact of a user with respect to another user for each user deriving work from another user (a user influence score).

For each type of score (document impact, user impact, document influence, user influence), two variations of the counter are kept, a global counter giving equal weight over all time, and a counter giving greater weight to more recent actions. For the counter which tracks more recent activity, a process periodically checks the reuse records and may decrement the counter(s) for instances of reuse which are sufficient old. One set of counters is decremented so as to represent the impact and influence in a recent period of time, while the global set of counters keeps track of global reuse across all time. In another embodiment, counters are not directly decremented, but the quantity added to the counter is inflated over time, giving the effect that more weight is given to more recent counters. For instance, the counter may be incremented by the number of references or the number of weeks since the system was first used.

In order to avoid ever-increasing counter values, content evaluator 104 may periodically rescale scores either by dividing the scores by a constant or a value based on the current date/time. Content evaluator 104 may store the last date of modification with a counter so that a different scale may be used for counters at different times. In one embodiment, every year content evaluator 104 will rescale a counter whenever it updates the counter. By looking at the date of modification and the counter value, content evaluator 104 determines which scale was used in order to normalize both counters to the same scale and do comparisons across counters. This gives the effect that counters may be compared at any time and indicate only relative impact or influence scores with respect to other documents, and different counters may be stored using different scales to avoid counter inflation overrunning storage constraints.

The counters may also be incremented by an amount dependent on the impact, influence, reach or engagement of the derivative work. For instance, if the derivative work receives a great deal of likes and comments, the counter may be incremented by more than if the derivative work receives no likes or comments. For this reason, the counters may be recomputed at a later time based on the records in the database or actions on the derivative works (for instance, liking) may also cause the counters for the original work to be incremented or modified.

Referring now to FIG. 3B, in conjunction with FIGS. 1-2, in step 310, content evaluator 104 increments a counter keeping track of the number of times the user (e.g., the user who was detected in reusing the author's content in step 305) reuses the author's content.

In step 311, content evaluator 104 generates a score, referred to herein as the "impact score," representing the author's ability to influence other users to adopt the author's content in other users' derivative works. In one embodiment, the impact score is computed based on the number of times the author's content has been adopted in derivative works. The greater the number of times the author's content has been adopted in derivative works, the greater the impact score thereby indicating a greater influence on other users to adopt the author's content in their derivative works. In this manner, the impact of the author's content being utilized in a social network can be evaluated. In one embodiment, the impact score may take into consideration the date at which the content was reused. For example, content that was acquired from the author's document a very long time ago (e.g., two years ago) may be weighted less than content that was acquired from the author's document recently (e.g., yesterday). For instance, the value of the count of the counter may be less than a value of one if the content was acquired from the author's document a long time ago. Alternatively, the value of the count of the counter may be multiplied by a multiplier (e.g., the value of 2) for those more recent acquisitions. In one embodiment, the impact score may only be computed over a designated period of time (e.g., recent year) thereby ignoring those times that the content was adopted in derivate works a long time ago to obtain a more accurate assessment as to the current influence the author has on influencing others to adopt portions of the author's content into derivative works.

In step 312, content evaluator 104 generates a score, referred to herein as the "influence score," representing the author's ability to influence the user (e.g., the user who was detected in reusing the author's content in step 305) to utilize the author's content based on the number of times the user reuses the author's content. In one embodiment, the influence score is computed based on the number of times the user (e.g., the user who was detected in reusing the author's content in step 305) reuses the author's content. The greater the number of times the user (e.g., the user who was detected in reusing the author's content in step 305) reuses the author's content, the greater the influence score thereby indicating a greater ability of the author to influence that particular user. In this manner, the impact of the author's content being utilized in a social network can be evaluated. In one embodiment, the influence score may take into consideration the date at which the content was reused. For example, the author's content that was reused by a user a very long time ago (e.g., two years ago) may be weighted less than content that was reused by the user recently (e.g., yesterday). For instance, the value of the count of the counter may be less than a value of one if the author's content was reused a long time ago. Alternatively, the value of the count of the counter may be multiplied by a multiplier (e.g., the value of 2) for those more recent reuses of the author's content by the user. In one embodiment, the influence score may only be computed over a designated period of time (e.g., recent year) thereby ignoring those times that the author's content was reused by the user a long time ago to obtain a more accurate assessment as to the author's current ability to influence the user to reuse the author's content.

In step 313, content evaluator 104 provides social credit to the author (e.g., user of client device 101) using the impact score (generated in step 311). For example, in one embodiment, content evaluator 104 inserts the impact score in the author's profile thereby providing the means for informing the author as to the extent of the impact of the author's created content. In this manner, recognition is provided to the author of content being utilized in a social network thereby providing motivation for users to post created content in the social network. A document impact score may be shown when viewing a document and a user influence score may be shown on a user profile to show the user's influence on the current user. As discussed further below, there are other means for informing the author as to the extent of the impact of the author's created content, such as graphically.

In step 314, content evaluator 104 ranks the users (e.g., users of client devices 101A-101C) based on their impact scores thereby providing an indication as to extent of the user's impact of the user's created content among other users who have had their content reused.

In step 315, content evaluator 104 generates a graph representing the author's ability to influence other users to adopt the author's content in the other users' derivative works using the impact scores of users as illustrated in FIG. 4.

FIG. 4 is a graph representing the author's ability to influence other users to adopt the author's content in the other users' derivative works in accordance with an embodiment of the present invention. In one embodiment, a global interface is provided for organization administrators to view pairwise influence scores between users and allow them to understand the information flow in their organization. This may be depicted as a graph with nodes representing users along with labeled directed edges representing cases where one user has derived work from another user labeled with the influence score of one user on another. In another embodiment, the influence scores may be represented graphically by the thickness, color, length or other quality of an edge in the graph. Content evaluator 104 may make available to any user a visualization constrained to the edges originating or terminating at that user.

Referring to FIG. 4, in conjunction with FIGS. 1-2 and 3A-3B, graph 400 illustrates the relationship between documents 401A-401E where document 401A represents the document of "TwoEasySteps.ppt" prepared by User B and is assigned the impact sore of 62 (represented by circle 402A), document 401B represents the document of "ThreeEasySteps.ppt" prepared by User C and is assigned the impact score of 102 (represented by circle 402B), document 401C represents the document of "FiveEasySteps.ppt" prepared by User A and is assigned the impact score of 71 (represented by circle 402C), document 401D represents the document of "TenEasySteps.ppt" prepared by User X and is assigned the impact sore of 71 (represented by circle 402D) and document 401E represents the document of "FiftyEasySteps.ppt" prepared by User Y and is assigned the impact sore of 71 (represented by circle 402E).

As illustrated in FIG. 4, there is an arrow pointing from impact score 402A to impact score 402B thereby indicating that document 401B contains content that was taken from document 401A (content of the author of document 401A). As also illustrated in FIG. 4, there is an arrow pointing from impact score 402B to impact score 402C thereby indicating that document 401C contains content that was taken from document 401B (content of the author of document 401B). Furthermore, as illustrated in FIG. 4, there are arrows pointing from impact score 402C to impact scores 402D and 402E thereby indicating that documents 401D and 401E contain content that was taken from document 401C (content of the author of document 401C). In one embodiment, the relationship between these documents is obtained based on the stored mapping of the source of the reused content with the document containing the reused document as discussed above in connection with steps 307 and 308. Furthermore, the impact scores shown in FIG. 4 are generated as discussed above in connection with step 311.

Since graph 400 is generated from the perspective of the version of document 401C (document entitled "FiveEasySteps.ppt"), there is a box 403 surrounding the identification of document 401C along with its impact score 402C of 71. As a result, graph 400 does not illustrate as to why the other documents, such as document 401B, is assigned a particular impact sore (e.g., document 401B is assigned an impact score of 102 as represented by circle 402B). For example, document 401B may be assigned an impact of 102 since its author's content was reused by many documents that are not shown in graph 400 and because other content in document 401B is reused in further documents.

As also illustrated in FIG. 4, graph 400 indicates a time line of usages of the author's content. For example, as discussed above, FIG. 4 illustrates that the author's content of document 401A was reused in document 401B and that the author's content of document 401B was reused in document 401C and that the author's content of document 401C was reused in documents 401D and 401E.

Documents 401A-401E may collectively or individually be referred to as documents 401 or document 401, respectively. Furthermore, impact scores 402A-402E may collectively or individually be referred to as impact scores 402 or impact score 402, respectively. While FIG. 4 illustrates five documents 401 with their corresponding impact scores 402, graph 400 may include any number of documents 401 with their corresponding impact scores 402 based on how many users reused content from the perspective of the version of document 401 in question (e.g., document 401C) as well as how many levels of derivation from the document containing the original content (e.g., document 401A) that was directly or indirectly used by the document 401 in question (e.g., document 401C).

In one embodiment, content evaluator 104 generates graphs composed of all walks through the current document.

This may be computed by walking first forward from the node along all outgoing connections and then backward along all incoming edges, both up to a certain depth, for instance, for 3 connections. Efficiency may be gained by only showing a subset of the edges when a large number of outgoing or incoming connections exist at any node. Content evaluator 104 tracks at each node (user or document depending on the graph) the number of outgoing and incoming connections or edges, sorting by this value when selecting the list of nodes so that the nodes with the most connections are displayed first. Furthermore, in one embodiment, the user may select "show more" at any level or node to see more connections. Other sorting criteria are available. For example, sorting may be based on a user's impact or influence score on the current user for documents associated with each node or sorting may be based on the influence score of the current user with respect to the document owner or even the document's influence score. As a result, this allows the user to walk a graph discovering the documents which are influenced by or are influencing their work, with preference given to authors who are strongly influenced by or influencing their work.

In one embodiment, a user may be able to identify which content was reused in a particular document, such as by hovering over a particular edge/arrow in graph 400 as illustrated in FIG. 5.

FIG. 5 illustrates a user identifying which content was reused in a particular document from graph 400 in accordance with an embodiment of the present invention.

Referring to FIG. 5, FIG. 5 illustrates the user hovering over the edge/arrow from impact score 402C to impact score 402E to learn which content was taken from document 401C and incorporated in document 401E. As illustrated in FIG. 5, the FiftyEasySteps.ppt document 401E reused some text which begins with "Step 1: Think of a problem you encounter . . . " 501 from the FiveEasySteps.ppt document 401C.

Returning to FIG. 3B, in conjunction with FIGS. 1-2 and 4-5, in step 316, content evaluator 104 prioritizes the notifications and display of events in an activity stream based on the impact and influence scores (generated in steps 311 and 312) as illustrated in FIG. 6.

FIG. 6 illustrates an activity stream 600 prioritizing notifications and the display of events based on the impact and influence scores in accordance with an embodiment of the present invention.

Referring to FIG. 6, activity stream 600 prioritizes notifications 601A ("User A commented on a file" regarding "Example File A") and 601B ("User B commented on a file" regarding "example file B") based on impact and influence scores of the files associated with these notifications 601A, 601B. For example, since example file A associated with notification 601A has a higher impact score ("social impact score") (impact score of 71) than example file B associated with notification 601B (impact score of 45) and the influence score ("social impact relative to viewer") associated with example file A (influence score of 24) is not much less than the influence score associated with example file B (influence score of 29), notification 601A is displayed prior to notification 601B in activity stream 600.

In one embodiment, the user has an option to sort notifications and the display of events based solely on using the impact or influence scores. Since influence and impact scores may be weighted in such a way as to give greater weight to newer references, sorting by influence or impact may give greater priority to more recent references.

Notifications 601A-601B may collectively or individually be referred to as notifications 601 or notification 601, respectively. While FIG. 6 illustrates two notifications, content evaluator 104 may prioritize any number of notifications 601 and events in activity stream 600 based on the impact and influence scores. Those notifications 601 and events that are associated with a higher impact and influence scores will be displayed prior to those notifications 601 and events with a lower impact and influence scores.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

The invention claimed is:

1. A method for evaluating an impact of a user's content utilized in a social network, the method comprising:

analyzing a document posted on a social network environment, wherein said document comprises a written communication that is posted on said social network environment;

generating a hash value for a portion or an entirety of said document;

determining whether said generated hash value matches any previously stored hash values;

detecting content in said document posted on said social network environment being reused by a second user in response to said generated hash value matching a previously stored hash value;

identifying an author of said content by mapping said author to said previously stored hash value that matches said generated hash value;

incrementing a first counter keeping track of a number of times said content has been adopted in derivative works, wherein said derivative works are works based on or derived from said content;

incrementing a second counter keeping track of a number of times said second user reuses said author's content;

generating, by a processor, an impact score representing an ability of said author to influence other users to adopt said content in derivative works of said other users based on said number of times said content has been adopted in said derivative works;

generating an influence score representing said author's ability to influence said second user to utilize said author's content based on said number of times said second user reuses said author's content; and providing social credit to said author of said content using said impact score.

2. The method as recited in claim 1 further comprising:

generating a graph representing said author's ability to influence said other users to adopt said author's content in said other users' derivative works using said impact score.

3. The method as recited in claim 2, wherein said graph indicates a time line of usages of said author's content.

4. The method as recited in claim 1 further comprising:

identifying a source document from which said reused content was acquired; and storing a mapping of said source document with said document containing said reused content.

5. The method as recited in claim 1 further comprising:

prioritizing notifications and display of events in an activity stream based on said impact and influence scores.

6. The method as recited in claim 1, wherein said impact and influence scores take into consideration a date at which said content was reused.

7. The method as recited in claim 1, wherein said document is one of the following: a social media post, an electronic message, a word processing document and a presentation.

8. A computer program product for evaluating an impact of a user's content utilized in a social network, the computer program product comprising a computer readable storage medium having program code embodied therewith, the program code comprising the programming instructions for:

analyzing a document posted on a social network environment, wherein said document comprises a written communication that is posted on said social network environment;

generating a hash value for a portion or an entirety of said document;

determining whether said generated hash value matches any previously stored hash values;

detecting content in said document posted on said social network environment being reused by a second user in response to said generated hash value matching a previously stored hash value;

identifying an author of said content by mapping said author to said previously stored hash value that matches said generated hash value;

incrementing a first counter keeping track of a number of times said content has been adopted in derivative works, wherein said derivative works are works based on or derived from said content;

incrementing a second counter keeping track of a number of times said second user reuses said author's content;

generating an impact score representing an ability of said author to influence other users to adopt said content in derivative works of said other users based on said number of times said content has been adopted in said derivative works;

generating an influence score representing said author's ability to influence said second user to utilize said author's content based on said number of times said second user reuses said author's content; and providing social credit to said author of said content using said impact score.

9. The computer program product as recited in claim 8, wherein the program code further comprises the programming instructions for:

generating a graph representing said author's ability to influence said other users to adopt said author's content in said other users' derivative works using said impact score.

10. The computer program product as recited in claim 9, wherein said graph indicates a time line of usages of said author's content.

11. The computer program product as recited in claim 8, wherein the program code further comprises the programming instructions for:

identifying a source document from which said reused content was acquired; and storing a mapping of said source document with said document containing said reused content.

12. The computer program product as recited in claim 8, wherein the program code further comprises the programming instructions for:

prioritizing notifications and display of events in an activity stream based on said impact and influence scores.

13. The computer program product as recited in claim 8, wherein said impact and influence scores take into consideration a date at which said content was reused.

14. The computer program product as recited in claim 8, wherein said document is one of the following: a social media post, an electronic message, a word processing document and a presentation.

15. A system, comprising:

a memory unit for storing a computer program for evaluating an impact of a user's content utilized in a social network; and a processor coupled to the memory unit, wherein the processor is configured to execute the program instructions of the computer program comprising:

analyzing a document posted on a social network environment, wherein said document comprises a written communication that is posted on said social network environment;

generating a hash value for a portion or an entirety of said document;

determining whether said generated hash value matches any previously stored hash values;

detecting content in said document posted on said social network environment being reused by a second user in response to said generated hash value matching a previously stored hash value;

identifying an author of said content by mapping said author to said previously stored hash value that matches said generated hash value;

incrementing a first counter keeping track of a number of times said content has been adopted in derivative works, wherein said derivative works are works based on or derived from said content;

incrementing a second counter keeping track of a number of times said second user reuses said author's content;

generating an impact score representing an ability of said author to influence other users to adopt said content in derivative works of said other users based on said number of times said content has been adopted in said derivative works;

generating an influence score representing said author's ability to influence said second user to utilize said author's content based on said number of times said second user reuses said author's content; and providing social credit to said author of said content using said impact score.

16. The system as recited in claim 15, wherein the program instructions of the computer program further comprise:

generating a graph representing said author's ability to influence said other users to adopt said author's content in said other users' derivative works using said impact score.

17. The system as recited in claim 16, wherein said graph indicates a time line of usages of said author's content.

18. The system as recited in claim 15, wherein the program instructions of the computer program further comprise:

identifying a source document from which said reused content was acquired; and storing a mapping of said source document with said document containing said reused content.

19. The system as recited in claim 15, wherein the program instructions of the computer program further comprise:

prioritizing notifications and display of events in an activity stream based on said impact and influence scores.

20. The system as recited in claim 15, wherein said impact and influence scores take into consideration a date at which said content was reused.

* * * * *